US008014556B2

(12) United States Patent
Goldberg

(10) Patent No.: US 8,014,556 B2
(45) Date of Patent: Sep. 6, 2011

(54) SPEAKER SYSTEM FOR HEAD PROTECTIVE GEAR

(75) Inventor: Josh Goldberg, Santa Cruz, CA (US)

(73) Assignee: Central Coast Patent Agency, Inc., Watsonville, CA (US)

( * ) Notice: Subject to any disclaimer, the term of this patent is extended or adjusted under 35 U.S.C. 154(b) by 1308 days.

(21) Appl. No.: 11/567,275

(22) Filed: Dec. 6, 2006

(65) Prior Publication Data

US 2007/0098199 A1 May 3, 2007

Related U.S. Application Data

(63) Continuation-in-part of application No. 11/282,335, filed on Nov. 18, 2005, now Pat. No. 7,403,632.

(60) Provisional application No. 60/748,831, filed on Dec. 8, 2005, provisional application No. 60/637,733, filed on Dec. 20, 2004.

(51) Int. Cl.
*H04R 1/00* (2006.01)
*H04R 9/06* (2006.01)

(52) U.S. Cl. ..... 381/415; 381/396

(58) Field of Classification Search ..... 381/396, 381/397, 400, 401, 407, 412, 413, 415; 84/273; 181/146; 379/433.02

See application file for complete search history.

(56) References Cited

U.S. PATENT DOCUMENTS 7,270,640 B2 * 9/2007 Boys ..... 601/78
7,291,780 B2 * 11/2007 Hosler ..... 84/723

* cited by examiner

*Primary Examiner* — Brian Ensey
(74) *Attorney, Agent, or Firm* — Donald R. Boys; Central Coast Patent Agency, Inc.

(57) ABSTRACT

A headgear system enhanced for generating sound has at least one speaker apparatus connected to or integrated into the structure of the headgear system, the speaker apparatus including a magnet suspended in a magnetic fluid, and at least one resonator connected to the at least one speaker apparatus. The system is characterized in that excitation of the magnet produces vibration translated to the resonator to generate the sound.

17 Claims, 5 Drawing Sheets

SPEAKER SYSTEM FOR HEAD PROTECTIVE GEAR

CROSS-REFERENCE TO RELATED APPLICATIONS

The present invention is a continuation in part to a U.S. patent application Ser. No. 11/282,335, filed on Nov. 18, 2005, which claims priority to a U.S. provisional patent application Ser. No. 60/637,733, filed on Dec. 20, 2004. The instant application also claims priority to provisional application Ser. No. 60/748,831 filed on Dec. 8, 2005. All of the above mentioned specifications are included herein at least by reference.

BACKGROUND OF THE INVENTION

1. Field of the Invention

The present invention is in the field of audio output devices or speakers and pertains particularly to speaker devices for integration into protective head gear such as a helmet.

2. Discussion of the State of the Art

There are speaker and earpiece solutions that exist in the art for use in protective headgear such as motorcycle helmets, for example, to be able to listen to music or radio communications. In the current state of the art, most protective headgear systems require placement of an audio output device or speaker directly over the ear of the user wearing the gear. Moreover, such devices are fixed speaker devices that use some type of fragile materials for the vibrating member of the device such as a paper speaker cone for example. Without this vibrating member, the speaker would have to be inserted directly into the ear of the user like an ear-bud for example. These implementations, while sufficient for producing sound that a user can hear, often prove to be uncomfortable for the user, causing irritation, and sometimes pain in the ear due to the location of the device inside or directly against the ear of the user. Blocking the ear from ambient sounds by wearing traditional headphones can also be a safety hazard or illegal.

What is clearly needed is a speaker system for integration into protective headgear systems that produces sufficient sound that a user may hear without the requirement of placing speakers at close proximity to the ears of the user.

SUMMARY OF THE INVENTION

A headgear system enhanced for generating sound is provided. The system includes at least one speaker apparatus connected to or integrated into the structure of the headgear system, the speaker apparatus including a magnet suspended in a magnetic fluid and at least one resonator connected to the at least one speaker apparatus. Excitation of the magnet produces vibration translated to the resonator to generate the sound.

In one embodiment, the resonator is the structure of the headgear system. In another embodiment, the resonator is a thin material suspended in the liner of the headgear system. In one embodiment, the headgear is one of a motorcycle helmet or a racing helmet. In a variation of this embodiment, the at least one speaker is suspended in the liner of the headgear system and is connected to the resonator. In another variation of this embodiment, the at least one speaker is externally mounted. In one embodiment, the headgear system further includes an audio source device.

According to another aspect of the invention, a method is provided for generating audio from a headgear system using at least one speaker apparatus including a magnet suspended in a magnetic fluid. The method includes the acts (a) powering on an audio source connected to the at least one speaker apparatus while wearing the headgear, (b) exciting the magnet to vibrate, and (c) transferring the vibration from the magnet through the magnetic fluid to a resonator generating the audio.

In one aspect of the method the audio source is powered on from the headgear system. In one aspect the headgear is a motorcycle helmet. In another aspect the audio source communicates wirelessly to the at least one speaker apparatus.

In preferred aspects of the method the magnet is excited by current traveling through a coil. In one aspect, the magnet is suspended in ferrofluid one suspended magnet for each speaker present in the system.

In one aspect of the method, the resonator is a thin device located inside the headgear system. In another aspect, the headgear structure is the resonator. In still another aspect, the resonator is the container of the magnetic fluid. In one aspect, the to magnetic fluid is ferrofluid.

BRIEF DESCRIPTION OF THE DRAWING FIGURES

FIG. 1*a* is a sectioned elevation view of a speaker in an embodiment of the Present invention.

FIG. 1*b* is a plan view of the speaker of FIG. 1*a*.

DETAILED DESCRIPTION

Figure 1A:
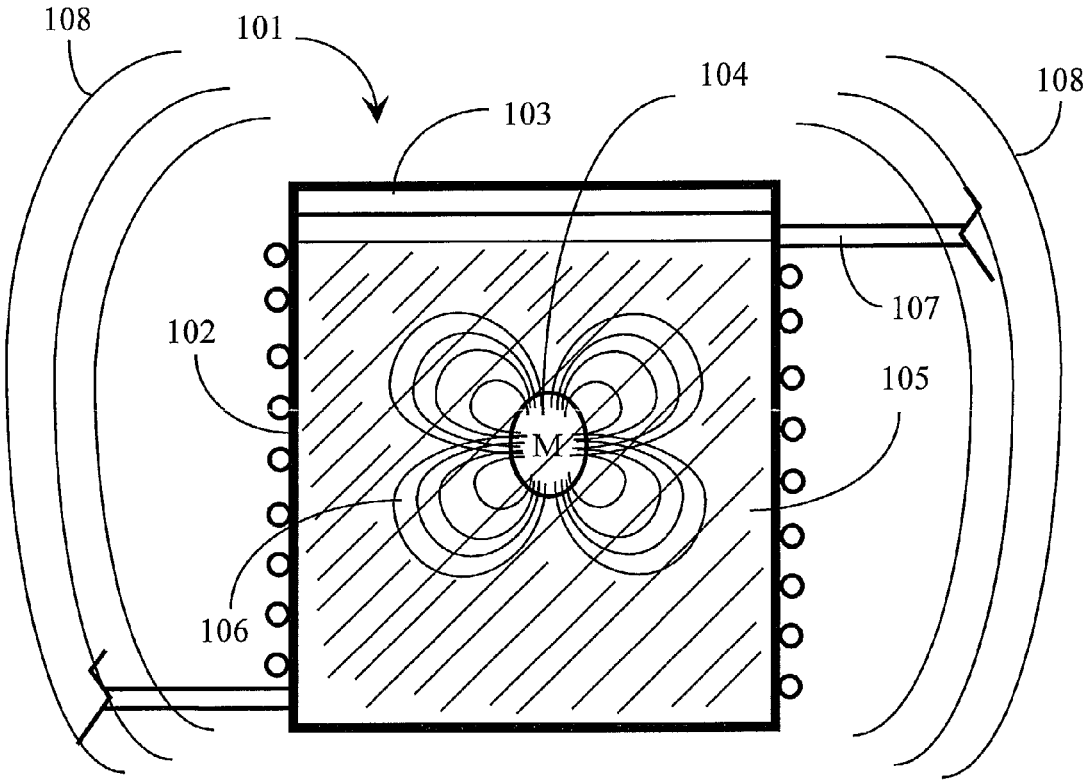
Figure 1B:
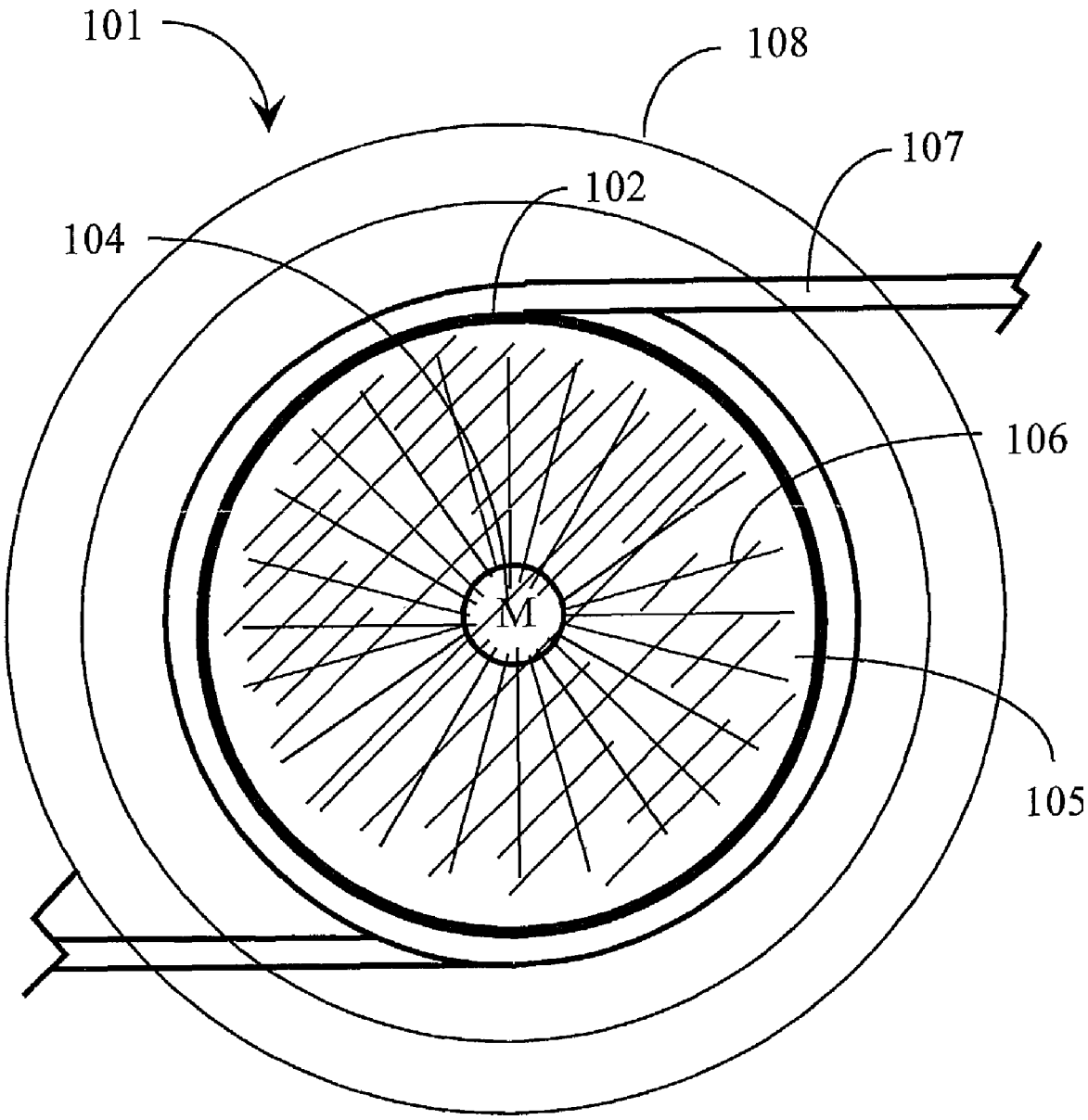

FIGS. 1*a* and 1*b* show an elevation view and a plan view respectively of a speaker 101 used in a preferred embodiment of the present invention. Speaker 101 in this embodiment includes an outer container 102. Container 102 may be a polymer container, like a pill bottle, or a container provided of some other durable material. The container in this example has a lid 103 which may be removed to fill the container at least partially with a ferrofluid 105. A ferrofluid is a stable colloidal suspension of sub-domain magnetic particles in a liquid or semi-liquid carrier. The particles, which in one embodiment have an average size of about 100 Å (10 nm), may be coated with a stabilizing dispersing agent (surface-acting, or surfactant) which prevents particle agglomeration even when a strong magnetic field gradient is applied to the ferrofluid. In the absence of a magnetic field, the magnetic moments of the particles are randomly distributed and the fluid typically has no net magnetization.

An unanchored permanent magnet 104, labeled M is suspended in the ferrofluid as a primary force generator. The permanent magnet in this embodiment is freely suspended inside container 102 that contains the ferrofluid 105 that provides dampening and force transmission. Lines of magnetic force 106 related to the permanent magnet cause the permanent magnet to be suspended in the ferrofluid.

A coil 107, in this case of electrically conductive metal, for transmitting an audio signal from a source, is wound about container 102 in this example to complete the speaker construction. The coil acts as an excitation apparatus for the permanent magnet in proximity of the container. The coil may, in some embodiments be encapsulated in the container walls, may be adhered to the container in different ways, or may be situated separately from the container such that the coil is not subject to forces acting on the container walls. In some embodiments there may be multiple coils arranged in different geometry for various purposes. One might desire, for example to have bass audio transmitted by one coil, and other audio by another. Audio directional effects may be varied by different coils in different geometry as well.

In this example the coil is connected to an output of an audio amplifier, not shown, such as an amplifier that drives a conventional speaker. The signal on the coil generates a varying magnetic field in the environment of the permanent magnet, which is immersed and suspended in the ferrofluid. The varying field from the coil vibrates the magnet, which movement transmits movement by force across the essentially incompressible ferrofluid to walls of the container. The container walls act as a sound resonator in place of the paper or metal cone of conventionally designed speakers, causing pressure perturbations in the surrounding air, indicated in FIGS. 1*a* and 1*b* by pressure lines 108.

It is not required that the container, such as container 102 in this example, be of the shape of a bottle, as shown. In some embodiments the container may be spherical, or egg-shaped, or may have some other shape depending on aesthetic or acoustical considerations. The container may also be made of any one or a combination of different materials, including, but not limited to plastic, metal or other durable materials.

In some embodiments the container may be connected to structures that may then function as a resonator. One advantage of such a design is that there are no fragile moving parts, such as a paper cone, that may tear when too high an input signal is provided, or that may degrade substantially over time. In another embodiment the container may be attached to a conventional cone of a conventional speaker. In another embodiment the container is cone made of a high strength material.

Magnet strength may be chosen in coordination with the viscosity of the ferrofluid, particle size in ferrofluid, saturation magnetization, and volume of ferrofluid used, as well as in concert with other considerations. Due to various properties of ferrofluids in reaction to the field of the permanent magnet, the fluid gathers into a substantially spherical shape around the core magnet that is placed inside the container. The number of coils should be sufficient to generate a substantial force on the magnet/fluid system and a standard impedance value for audio output systems may be preferred. The leads of the coil should be attached to an appropriate audio source for the rest of the construction parameters chosen.

To enhance the sound quality and ensure that the primary drive magnet stays floating or suspended in the ferrofluid, magnets of significantly lesser strength may be placed in opposite polarity to the primary magnet at the ends of the drive cylinder.

In one prototype design a fragment of a permanent magnet from a computer hard drive is used, and suspended in a volume of approx. 25 ml of ferrofluid in a plastic prescription pill bottle. The ferrofluid used in this particular prototype has the following properties:

Ferrotec EFH1

Medium—Light Mineral Oil

Saturation Magnetization—400 Gauss

Density—1.21 gm/ml

Viscosity—6 centipoise (cp) @ 27° C.

Surface Tension—29 dynes/cm

This volume of ferrofluid is placed in a cylinder approx 0.75" in diameter and 1.5" in height. Fifty coils of 20ga. magnetic wrap wire are used for electromagnetic excitation. For additional amplification, the container is placed inside a tin can approx 3.5" in diameter and 1" in height. The core apparatus is held in place by a light foam insulator that fills the remainder of the tin can resonator.

This prototype is sufficient to listen to television audio and music at reasonable volume levels and with negligible distortion from a distance of up to about thirty feet. In other embodiments the number of coils may be significantly increased and the gauge of wire used significantly decreased. The number of coils and gauge of wire used in this prototype were chosen to allow manual assembly and manipulation. A magnet of known strength and shape might be chosen to best attenuate the signal of the coils. The properties and volume of ferrofluid might also need to change based on the properties of the coil and magnet used. In practice, a cylinder might still be a favorable shape for a container, due to properties of magnetic coils. However the shape and size may change to best suit any application.

Headgear System

Figure 2:
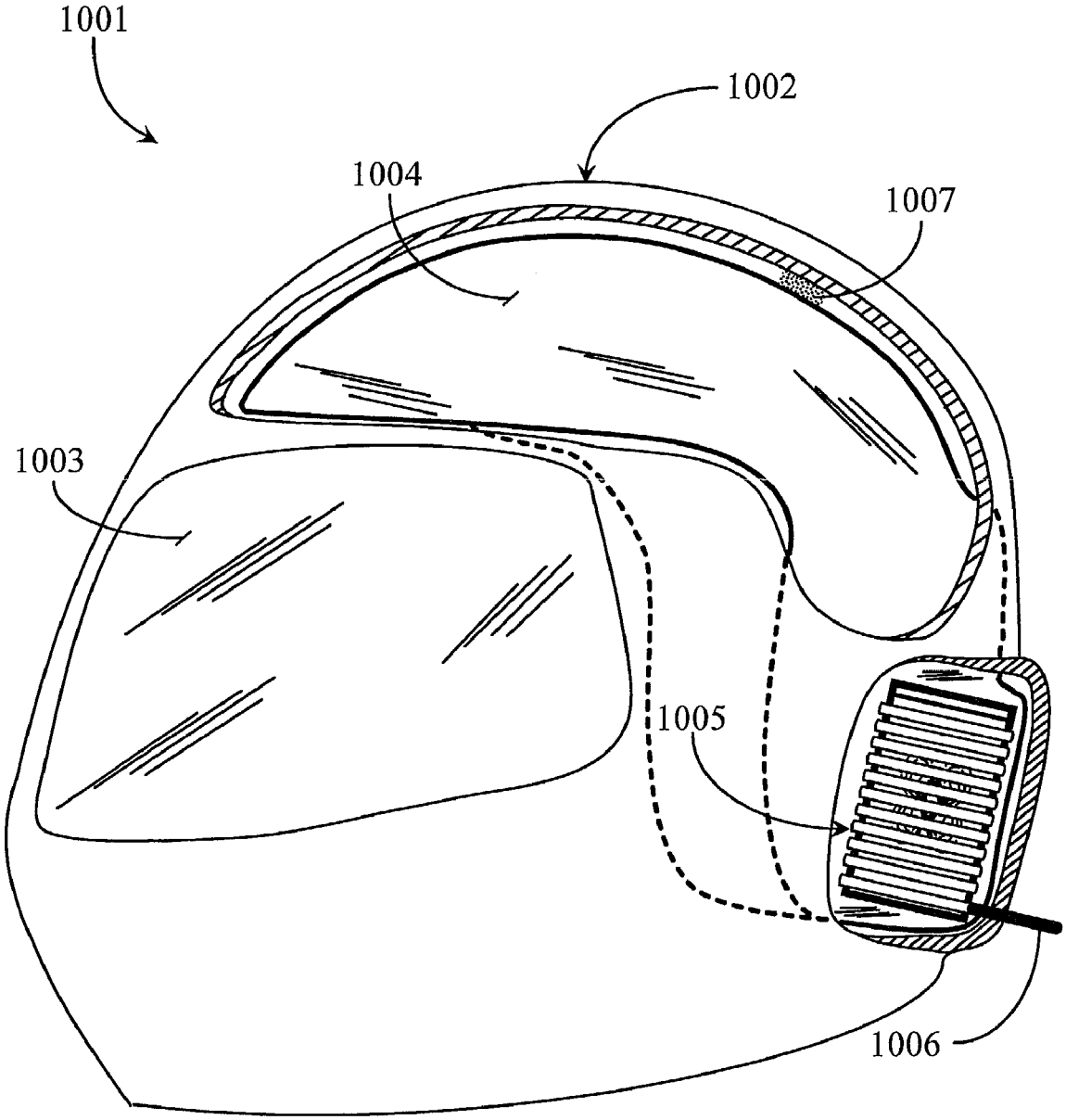
FIG. 2 is a section view of a protective headgear system enhanced with a speaker system according to an embodiment of the present invention.

FIG. 2 is a section view of a protective headgear system 1001 enhanced with a speaker system according to an embodiment of the present invention. The inventor provides a novel application for the speaker described further above in FIG. 1*a* and in FIG. 1*b*. Headgear system 1001 is a motorcycle helmet in the example. However, there are a wide variety of different types and designs for protective headgear used in many recreational, sports, and work related environments. For example, headgear 1001 may be a racing helmet, a football helmet or the like.

Headgear 1001 is constructed of a very durable polymer material 1002. Other materials may also be appropriate depending on the type of headgear and the required protective properties expected of it. Headgear 1001 has a transparent view window that enables the wearer to see while wearing the headgear. In one embodiment, headgear 1001 may have a double-walled construction. In this example, there is a lining of shock absorbent foam 1007 covering the inside wall of the headgear. Foam or some other comfortable lining is typical for many varieties of headgear.

In this embodiment, a speaker system is integrated into headgear 1001 to provide audible sound for a user to hear while wearing the headgear. The speaker system includes a ferrofluid speaker 1005. Speaker 1005 is analogous to speaker 101 described further above. In this example, speaker 1005 is integrated into the wall structure of headgear 1001. This may be accomplished during manufacture of the headgear by molding or forming a pocket or recess in the inside wall structure protruding outward a suitable amount for retaining the speaker. In this example, a portion of wall 1002 is removed to make speaker 1005 visible. In one embodiment, speaker 1005 is suspended in a headgear lining 1007.

Speaker 1005 has a coil lead 1006 that leads to an audio source such as a compact disc player, cassette player, radio receiver, or digital electronic music playing device. The device may be a hand-held music player or an in-dash music system. Lead 106 carries the electric signal from the audio source to speaker 1005 in the fashion of a speaker wire.

Coil 1006 is wrapped around the container of the ferrofluid in the same fashion as illustrated further above. However, in one embodiment the coil may be built into the wall of the container. In still another embodiment, the coil may be held separately from but still connected to the container for transferring resonation from the magnet through the ferrofluid into the container walls. In this example, resonation is further extended from the speaker walls of speaker 1005 to a special resonation device 1004. Resonation device 1004 may be provided to function as a sound resonator for the speaker system by mounting speaker 1005 to it in such a way as to enable transfer of the resonation from the speaker container to the device.

Resonator 1004 may be manufactured of a light weight durable and resilient material such as polymer, thin steel, or other materials that may be suitable for sound production in the fashion of a speaker cone or resonator by vibrating. In one embodiment, device 1004 may be manufactured of the same fibrous paper material that speaker cones are currently made of. In this example, a portion of headgear wall 1002 is removed to make device 1004 visible in this view. Device 1004 extends over the head of a user and down over both sides of the user's head. The device may be embedded within foam lining 1007 of headgear 1001 and may not actually come in contact with any other device except for speaker 1005 that provides vibrations to the device.

In this example, the selection of foam lining would be one that is sufficiently porous and does not muffle the sound of the music when the system is powered on and performing, yet still provides the level of safety required for standard use of the headgear. There are many standard lining materials that may be used and that would not severely dampen or limit sound quality in any way while providing required safety. Such materials are routinely used to enhance sound, prevent feedback, cancel noise, as well as to provide some cover for audio producing and recording devices.

In one embodiment, volume controls and an on/off switch (not illustrated) may be provided on the exterior surface of material 1002 in some strategic location that is convenient to the user. In this example, there is only one speaker 1005 illustrated, however more than one speaker may be provided without departing from the spirit and scope of the invention. Moreover, any strategic location may be selected for integrating speaker 1005 into headgear 1001. It is not required that speaker 1005 be placed anywhere near wear a user's ear would be to enable the invention. In this example resonating device 1004 produced the sound, which is audible on both sides of headgear system 1001. The exact locations of speaker 1005 and resonating device 1004 are exemplary only and illustrate one possible configuration out of several practical options.

Figure 3:
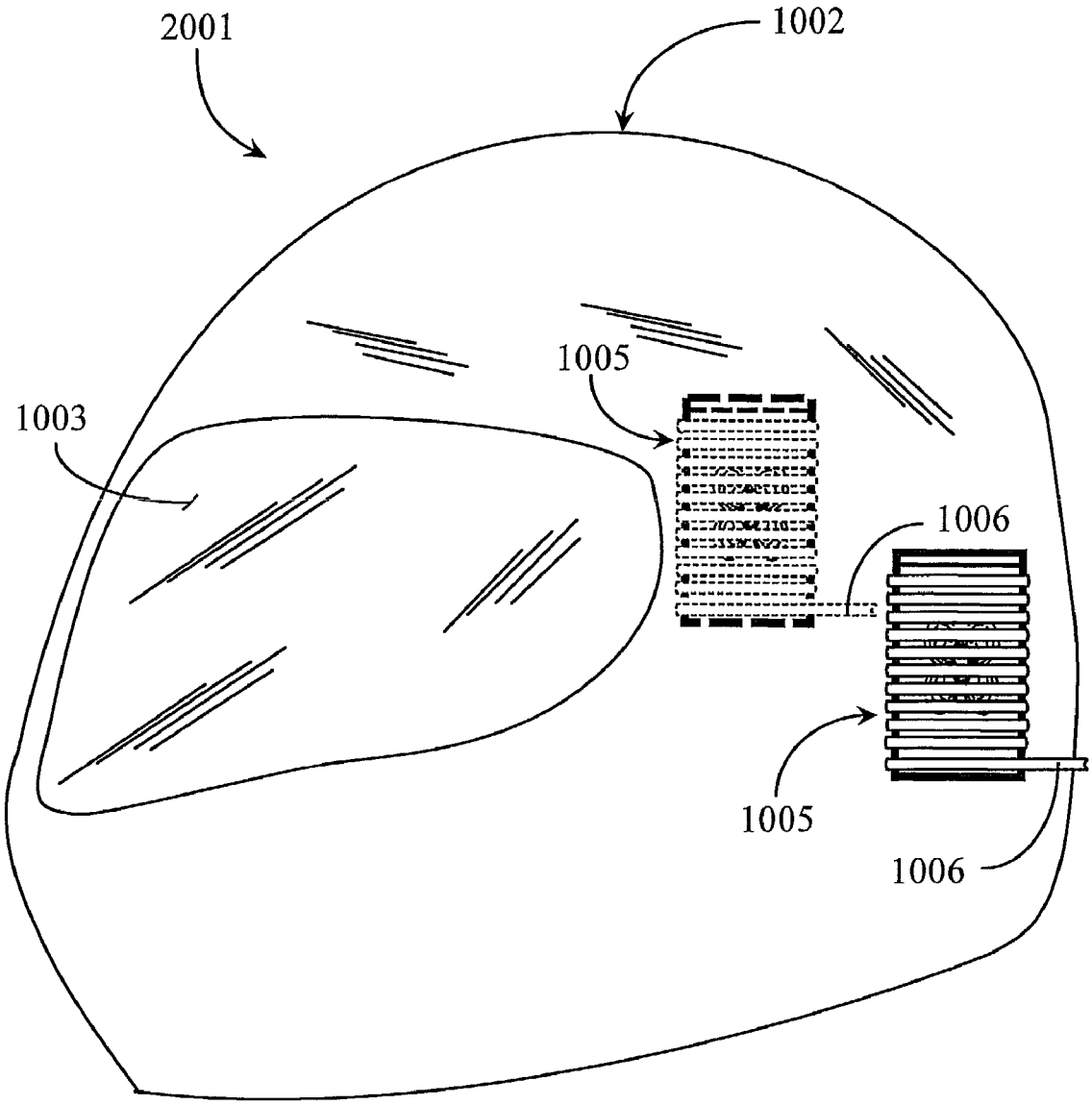
FIG. 3 is plan view of a protective headgear system enhanced with a speaker system according to another embodiment of the present invention.

FIG. 3 is plan view of a protective headgear system 2001 enhanced with a speaker system according to another embodiment of the present invention. Headgear system 2001 may be the same as similar to or different in construction that headgear system 1001 described above without departing from the spirit and scope of the present invention. In this example material 1002 is used in the construction of the helmet. Likewise transparent view window 1003 is illustrated.

In this example, a resonating device like device 1004 described above is not required in order to practice the present invention. Speaker 1005 is illustrated in plural in this example, rather two speakers 105 are provided. In this embodiment, speakers 1005 are externally mounted to headgear system 2001. In this example, speakers 1005 transfer vibration to the structure (1002) it self. Therefore the headgear functions as a resonator producing audible sound. Utilizing two speakers in this example provides two strategic locations for introducing the required vibrations into the headgear structure.

If the speakers assume a cylindrical shape, there may be cylindrical depressions molded into the headgear to accept more surface area of each cylinder to increase the transmission of vibration from each cylinder into the helmet. Leads 1006 emanating from each speaker 1005 connect to an audio source. In either embodiment of use of a separate resonator like resonator 1004, or where the helmet itself is the resonator, audio leads may be jacked into the helmet to make connection between the audio source and the coils of the speakers to activate the coils to excite the suspended magnets and produce the required vibrations. In another embodiment, one speaker line may be split to activate coils of more than one ferrospeaker In one embodiment, the audio source may also be built into the protective headgear systems 1001 or 2001. In this embodiment, the coil leads may be hardwired or soldered to the appropriate output wires of the audio source such as left and right speaker wires. In this embodiment, the audio source may be insulated for shock resistance using existing technologies.

It will be apparent to one with skill in the art that there are many different types of headgear that may be transformed into audio producing systems without departing from the spirit and scope of the present invention. For racing helmets and motorcycle helmets, the user's ears are covered by the helmets. In these applications, the user may hear the audio because the ears are protected from external noise like wind and motor sounds. However, it is not required in some embodiments that the headgear covers the user's ears to enable the user to hear the sound produced by the system of the invention. For example, bicycle helmets may be enhanced according to methods and apparatus of the invention whereby the sound produced is sufficient for listening in lower noise environments like a quiet bicycle ride for example. Bone conduction may also provide transmission of sound from a headgear to the ears. That is not to say however, that extension covers for the user's ears may not be conceived and provided for headgear systems that do not normally cover the user's ears. Therefore, the scope of the invention is not entirely dependant on the design of the headgear system in some embodiments.

Figure 4:
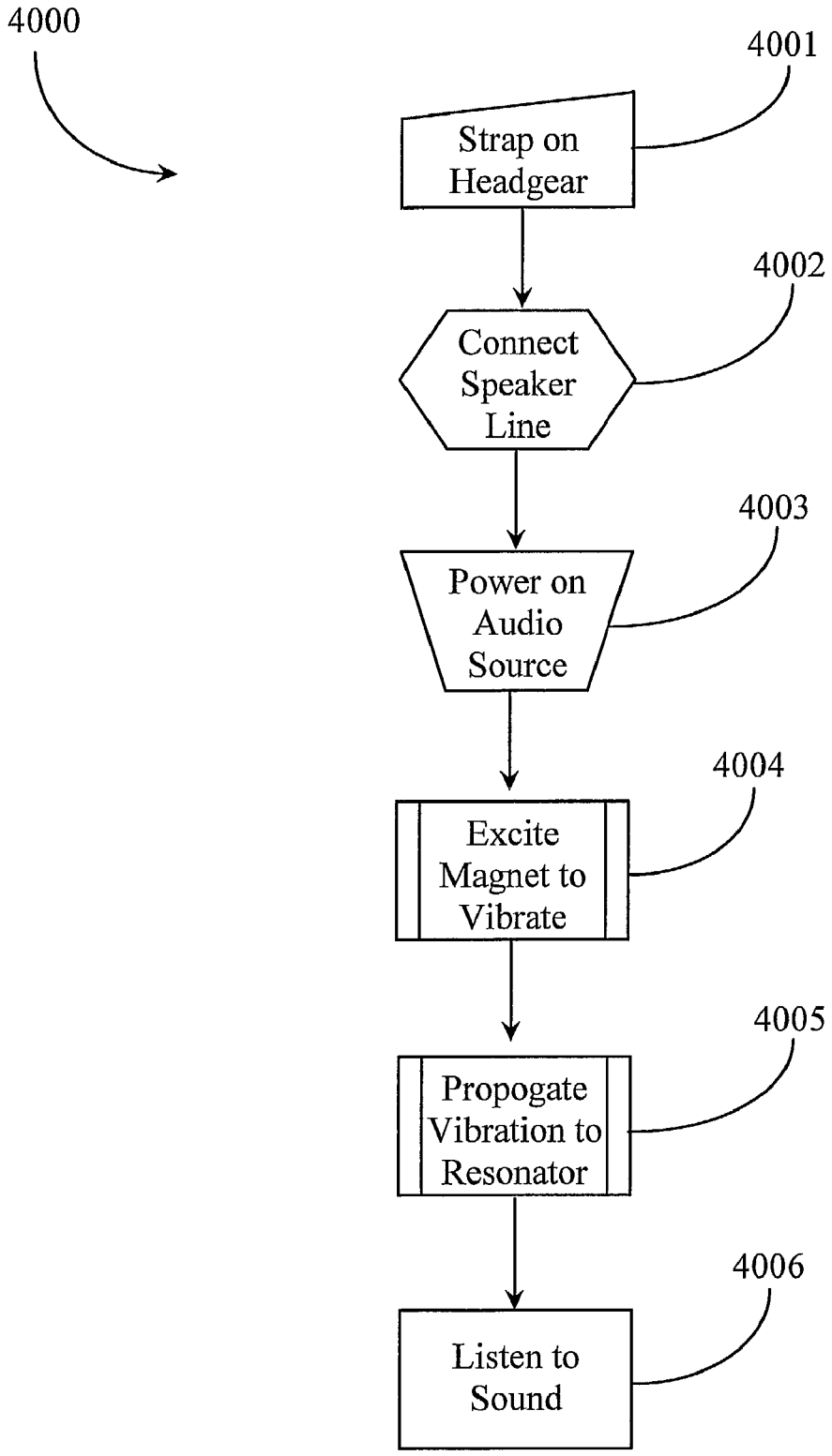
FIG. 4 is a process flow chart illustrating acts for generating audio for a protective headgear system according to an embodiment of the present invention.

FIG. 4 is a process flow chart illustrating acts 4000 for generating audio for a protective headgear system according to an embodiment of the present invention. In act 4001, a user straps on the headgear system enhanced according to the present invention. In act 4002, the user may connect one or more speaker lines to the coils of the one or more speakers of the system. In act 4003 then, the user may power on the audio source.

At act 4004, the electrical current excites the suspended magnet, or magnets of one or more speakers to vibrate. At act 4005, the vibration is translated to the resonator, which may be a special device like device 1004 described further above, or perhaps the helmet structure itself. In one embodiment, there is no translation of vibration from the speaker containers to another resonator. In this embodiment, the containers themselves produce sufficient audio resonation for the user to hear.

At act 4006 the user listens to the sound produced by resonation according to various embodiments of the invention. Various combinations and variations in the components described herein may be made without departing from the spirit and scope of the present invention. Additional components may be added without departing from the spirit and scope of the invention like treble and bass controls, volume controls, on and off controls, mute controls and override controls for intercom functions or audio alerts and the like. The system of the invention can be used as an entertainment system or as a security regimen, or as a combination of those embodiments.

In a digital embodiment, WiFi or Bluetooth may be used at the audio source to communicate with the speakers of the invention. In this embodiment, the proper receiver circuitry and digital to analog converter circuitry would be required to produce the vibration necessary to crate the sound. There are many possibilities.

The methods and apparatus of the present invention should be given the broadest possible scope under examination in light of the several embodiments described. The spirit and scope of the present invention is limited only by the following claims.

What is claimed is:

1. A headgear system enhanced for generating sound comprising:

at least one speaker apparatus connected to or integrated into the structure of the headgear system, the speaker apparatus including a magnet suspended in a magnetic fluid; and at least one resonator connected to the at least one speaker apparatus;

characterized in that excitation of the magnet produces vibration translated to the resonator to generate the sound.

2. The headgear system of claim 1, wherein the resonator is the structure of the headgear system.

3. The headgear system of claim 1, wherein the resonator is a thin material suspended in the liner of the headgear system.

4. The headgear system of claim 1, wherein the headgear is one of a motorcycle helmet or a racing helmet.

5. The headgear system of claim 3, wherein the at least one speaker is suspended in: the liner of the headgear system and is connected to the resonator.

6. The headgear system of claim 2, wherein the at least one speaker is externally mounted.

7. The headgear system of claim 1, further including an audio source device.

8. A method for generating audio from a headgear system using at least one speaker apparatus including a magnet suspended in a magnetic fluid including the steps of:

(a) powering on an audio source connected to the at least one speaker apparatus while wearing the headgear;

(b) exciting the magnet to vibrate; and (c) transferring the vibration from the magnet through the magnetic fluid to a resonator generating the audio.

9. The method of claim 8, where in step (a) the audio source is powered on from the headgear system.

10. The method of claim 8, wherein in step (a), the headgear is a motorcycle helmet.

11. The method of claim 8, wherein in step (a), the audio source communicates wirelessly to the at least one speaker apparatus.

12. The method of claim 8, wherein in step (b), the magnet is excited by current traveling through a coil.

13. The method of claim 8, wherein in step (b), the magnet is suspended in ferrofluid one suspended magnet for each speaker present in the system.

14. The method of claim 8, wherein in step (c), the resonator is a thin device located inside the headgear system.

15. The method of claim 8, wherein in step (c), the headgear structure is the resonator.

16. The method of claim 8, wherein in step (c), the resonator is the container of the magnetic fluid.

17. The method of claim 8, wherein in step (c), the magnetic fluid is ferrofluid.

* * * * *